United States Patent [19]

Smits

[11] Patent Number: 5,059,854

[45] Date of Patent: Oct. 22, 1991

[54] IMAGE INTENSIFIER TUBE COMPRISING A CHROMIUM-OXIDE COATING

[75] Inventor: Petrus G. H. J. Smits, Heerlen, Netherlands

[73] Assignee: U.S. Philips Corp., New York, N.Y.

[21] Appl. No.: 461,892

[22] Filed: Jan. 8, 1990

[30] Foreign Application Priority Data

Jan. 9, 1989 [NL] Netherlands ..... 8900039

[51] Int. Cl.[5] ..... H01J 31/50; H01J 29/88

[52] U.S. Cl. ..... 313/107; 313/524; 313/544; 313/525

[58] Field of Search ..... 313/107, 365, 380, 383, 313/388, 390, 479, 524, 527, 544, 106, 525; 250/213 VT

[56] References Cited

U.S. PATENT DOCUMENTS

| | | | |
|---|---|---|---|
| 3,026,437 | 3/1962 | Nikles | 313/527 |
| 3,577,027 | 5/1971 | Szegho | 313/524 |
| 4,045,700 | 8/1977 | Wulff | 250/213 VT |
| 4,459,508 | 7/1984 | Ichikawa et al. | 313/544 |

*Primary Examiner*—Donald J. Yusko
*Assistant Examiner*—Michael Horabik
*Attorney, Agent, or Firm*—William L. Botjer

[57] ABSTRACT

In an image intensifier tube comprising a photosensitive layer an insulating wall portion is coated with a layer of chromium oxide which is deposited in the form of a chromium nitrate layer which is subsequently baked at a temperature of approximately 525° C. A thin, suitably adhesive, uniform and transparent coating layer having a comparatively high resistance value is thus achieved.

4 Claims, 1 Drawing Sheet

IMAGE INTENSIFIER TUBE COMPRISING A CHROMIUM-OXIDE COATING

BACKGROUND OF THE INVENTION

The invention relates to an image intensifier tube, comprising a housing which is formed by an entrance window, an exit window and an envelope portion which consists partly of a translucent, electrically insulating material, which housing accomodates an entrance screen and an electron-optical system for imaging photoelectrons on an exit screen.

An image intensifier tube of this kind is known as an X-ray image intensifier tube from U.S. Pat. No. 3,026,437 and as a brightness intensifier tube from U.S. Pat. No. 4,286,148. In order to prevent local discharge phenomena in such tubes, a glass portion of the envelope is often coated with a semiconductor material on an inner side. In image intensifiers tubes comprising a photosensitive entrance screen, discharge phenomena are liable to have an image-disturbing effect because light then emitted activates the photosensitive layer, releasing, for example photoelectrons which are imaged on the exit screen, together with image-carrying photoelectrons, and thus participate in the imaging.

U.S. Pat. No. 3,026,437 mentions chromium oxide as an example of a coating material. Known coating layers have the drawback that the layer is not transparent because it consists of, for example green chromium oxide, or that the resistance of the layer is comparatively low so that a rather large leakage current occurs which substantially increases the power required for operating the tube. Moreover, known coating layers have a comparatively large thickness and their thickness and structure are not very uniform.

SUMMARY OF THE INVENTION

It is the object of the invention to mitigate the described drawbacks; to achieve this, an image intensifier tube of the kind set forth in accordance with the invention is characterized in that at least a part of a transparent envelope portion is coated with transparent chromium oxide.

Because a transparent portion of the envelope is coated with a transparent resistive layer in an image intensifier tube in accordance with the invention, the transparency is sustained so that via these portions the photocathode can be activated for test measurements and the like and a resistive layer exhibiting suitable adhesion and a comparatively high resistance is achieved.

In a preferred embodiment the image intensifier tube forms an X-ray image intensifier tube comprising a CSi entrance screen, the transparent portion of the envelope being situated near the exit screen. A coating layer in accordance with the invention enables suitable homogenization of the field strength across the surface and a suitably defined, comparatively small leakage current and also offers the possibility of external activation of the photocathode.

In a further embodiment, at least a part of the cylindrical housing of a brightness intensifier tube is coated with a transparent chromium-oxide layer, so that discharging phenomena are again avoided and a reliable, comparatively low leakage current is obtained. Because the power supply for these tubes is preferably small, a low leakage current is very attractive.

In a preferred embodiment, the translucent chromium-oxide layer is formed by depositing a comparatively thin layer of chromium nitrate by brushing, spraying or immersion, which layer is subsequently baked at approximately 520°-530° C. Thus, a thin, suitably adhesive and suitably uniform layer of chromium oxide having a comparatively high resistance and a comparatively low secondary emission coefficient is obtained, so that the risk of local discharges is strongly reduced.

BRIEF DESCRIPTION OF THE DRAWING

Some preferred embodiments in accordance with the invention will be described in detail hereinafter with reference to the drawing. Therein.

DETAILED DESCRIPTION OF THE PREFERRED EMBODIMENT

Figure 1:
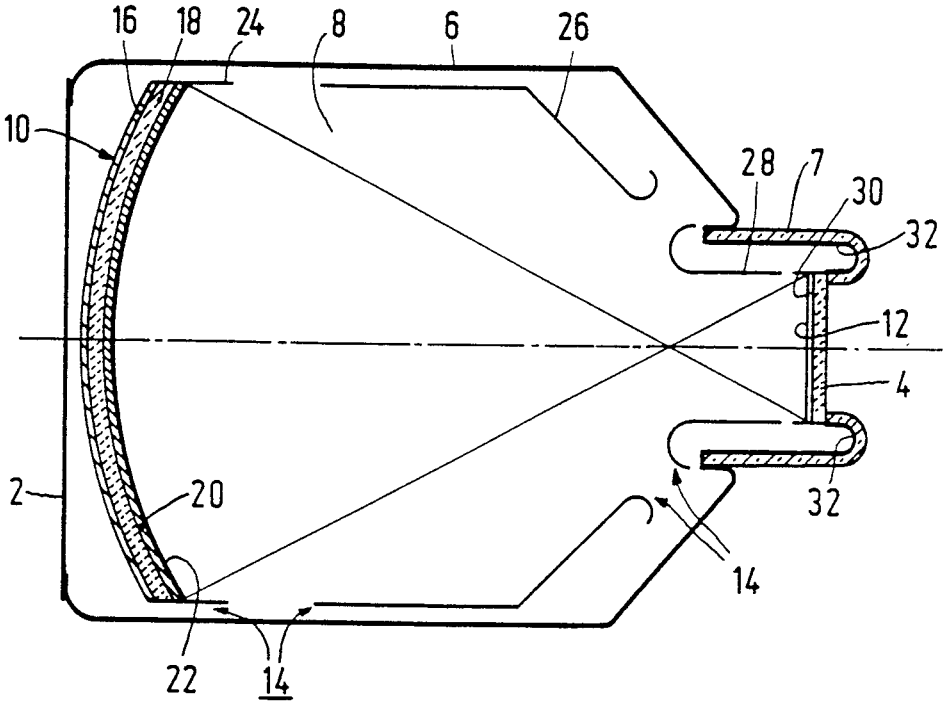
FIG. 1 shows an X-ray image intensifier tube in accordance with the invention.

An X-ray image intensifier tube as shown in FIG. 1 comprises an entrance window 2, an exit window 4, a cylindrical envelope 6 and an insulating ring 7 which together enclose an evacuated space 8. In the space 8 there are arranged an entrance screen 10, an exit screen 12, and an electron-optical imaging system 14. The entrance screen of the tube forms a separate foil, for example of titanium. Even for tubes comprising a large entrance window a titanium entrance window need not be thicker than, for example approximately 0.2 mm so that only a slight dispersion of an X-ray beam to be detected occurs therein. In this case the entrance screen comprises a concave support 16, preferably made of aluminium, which may also be thin because it does not serve as a vacuum wall. On the support there is provided a layer of luminescent material 18 on which there is provided a photocathode 22 with an intermediate barrier layer 20. The entrance screen constitutes, for example in conjunction with a shielding ring 24 which is also shown, a first electrode of the electron-optical imaging system 14; this system also includes a focusing electrode 26, a first anode 28 and an output anode 30 which is preferably in electrical contact with the exit screen. The envelope 6 of the housing has a circular cross-section in this case, but it may also have a rectangular shape, together with the exit, window, the entrance screen and possibly the exit screen and the exit window. The insulating ring 7 in this case consists of a translucent material and is coated in accordance with the invention with a layer of translucent chromium oxide 32 which is deposited on the inner side of the ring wall by the baking of chromium nitrate. A layer of chromium oxide thus obtained has a comparatively small thickness and a comparatively high resistance. The chromium nitrate is deposited, for example by immersion of the ring.

Figure 2:
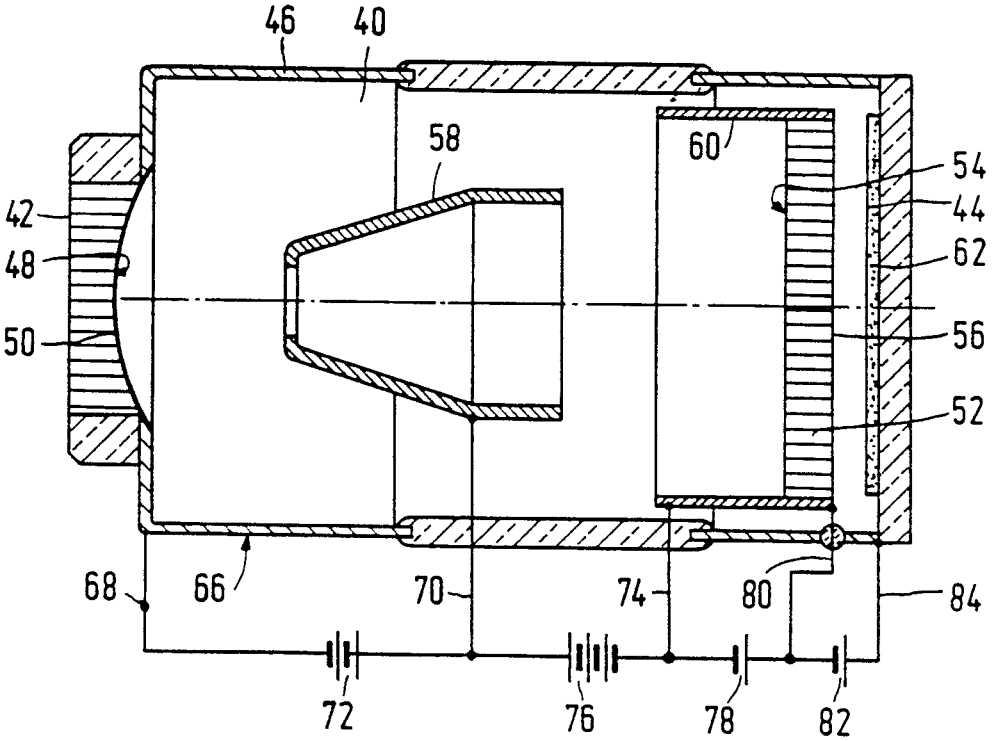
FIG. 2 shows a brightness intensifier tube in accordance with the invention.

FIG. 2 shows an image intensifier tube in accordance with the invention in the form of a brightness intensifier, comprising a housing 40 which includes a, for example fibre optical, entrance window 42, an exit window 44 and a cylindrical tube wall portion 46. A preferably concave inner side 48 of the entrance window is provided with a photocathode 50. Opposite the photocathode there is arranged a channel intensifier plate 52 having an entrance face 54 and an exit face 56. Because the photocathode and the channel plate there is arranged an electrode 58 and an electrode 60 which is arranged near the entrance face of the channel plate and which is preferably integral with a customary input electrode provided on the entrance face of the channel plate. Customary photocathodes have an electrical conductivity such that they may be considered to form an electrode in the electron-optical system. If this is not the case, an additional electrode which is transparent to the radiation to be measured can be provided. The inner side of the exit window 44 is provided with a luminescent layer 62. Via an electrically conductive wall portion 66, the photocathode 50 is connected to a terminal 68 and the intermediate electrode 58 is connected to a terminal 70. The intermediate electrode 70 can be adjusted to a positive potential which is comparatively high with respect to the photocathode, for example +5 kV, by means of a voltage source 72. The input electrode 60, being electrically integral with a channel input electrode provided on the channel entrance face 54, comprises a terminal 74. Via a voltage source 76, the input electrode can be adjusted to a potential which is comparatively low with respect to the intermediate electrode, for example +1 kV. Via a voltage source 78 and a terminal 80, an output electrode of the channel plate 52 can be adjusted to a higher potential with respect to the input electrode and, via a voltage source 82 and a terminal 84, the exit window can be adjusted to a somewhat higher potential again. In a practical embodiment of a tube notably the potentials which are relevent for the imaging of the photoelectrons on the channel plate will usually be derived from a common source, because any voltage variations then have a proportional effect on all potentials, so that the electron-optical setting is substantially less sensitive. The tube wall portion 46 in accordance with the invention is coated with a layer of transparent chromium oxide, so that a potential is achieved which varies uniformly across this portion, the relevant wall portion remains translucent and only a small leakage current occurs when the potentials are applied.

I claim:

1. An image intensifier tube, comprising a housing which is formed by an entrance window, an exit window and an envelope portion which consists partly of a translucent, electrically insulating material, which housing accommodates an electron-optical system for imaging photoelectrons from a photocathode onto an exit screen, characterized in that at least a part of the translucent envelope portion is coated with transparent chromium oxide.

2. An image intensifier tube as claimed in claim 1, further including an entrance screen disposed proximate said entrance window, said entrance screen including a layer of CSi with a photocathode provided thereon.

3. An image intensifier tube as claimed in claim 1, further including an entrance screen formed by a photocathode layer provided on an inner side of the entrance window.

4. An image intensifier tube as claimed in claim 1, characterized in that the chromium-oxide layer is provided in the form of a thin layer of chromium nitrate baked at a temperature of approximately 525° C.

* * * * *